United States Patent [19]

Jensen

[11] 4,295,307

[45] Oct. 20, 1981

[54] MODULAR BUILDING STRUCTURE

[76] Inventor: David C. Jensen, 2357 Riverside Dr., North Vancouver, British Columbia, Canada, V6B 1C8

[21] Appl. No.: 63,761

[22] Filed: Aug. 6, 1979

Related U.S. Application Data

[63] Continuation of Ser. No. 796,974, May 16, 1977, Pat. No. 4,186,533.

[51] Int. Cl.[3] ..... E04B 1/343; E04B 2/28

[52] U.S. Cl. ..... 52/236.1; 52/241; 52/127; 52/582; 52/489

[58] Field of Search ..... 52/236.1, 33, 36, 282, 52/489, 238, 239, 241, 580, 582, 584, 127, 263; 403/314

[56] References Cited

U.S. PATENT DOCUMENTS

| | | | |
|---|---|---|---|
| 1,889,355 | 11/1932 | Greenhill | 52/582 |
| 2,629,139 | 2/1953 | Thelander | 52/578 |
| 2,922,299 | 1/1960 | Deam | 52/127 |
| 3,365,851 | 1/1968 | Cushman | 52/127 |
| 3,372,518 | 3/1968 | Rensch | 52/586 |
| 3,465,487 | 9/1969 | Fatosme et al. | 52/489 |
| 3,626,652 | 12/1971 | Hanley | 52/586 |
| 3,729,889 | 1/1973 | Baruzzini | 52/586 |
| 3,826,056 | 7/1974 | Smith et al. | 52/586 |
| 3,830,030 | 8/1974 | Yoshida | 403/314 |
| 4,186,533 | 2/1980 | Jensen | 52/282 |

FOREIGN PATENT DOCUMENTS

| | | | |
|---|---|---|---|
| 224520 | 6/1959 | Australia | 52/127 |
| 1885302 | 8/1963 | Fed. Rep. of Germany . | |
| 1982065 | 2/1968 | Fed. Rep. of Germany . | |

*Primary Examiner*—James L. Ridgill

*Attorney, Agent, or Firm*—Robert W. Beach; Ward Brown

[57] ABSTRACT

In a modular wall and floor structure, the edges of wall panels have upwardly directed hooks pivoted for swinging between retracted positions and positions projecting outwardly from their opposite vertical edges. Short lengths of multisided hollow extrusion have a downwardly opening longitudinal slot in each side which slots receive the panel hooks of adjacent panels in projected positions for connecting such panels to form an exhibit array. Adjacent ends of overhead beams are connected to each other and to the upper ends of the panels by downwardly directed beam hooks received in upper longitudinal slots in the lengths of extrusion. The lower portions of the connected or unconnected panels can be clamped between modular floor components.

22 Claims, 15 Drawing Figures

9
12
11
13
6
8
7
10
28
5'
5
3
4
2
1
30

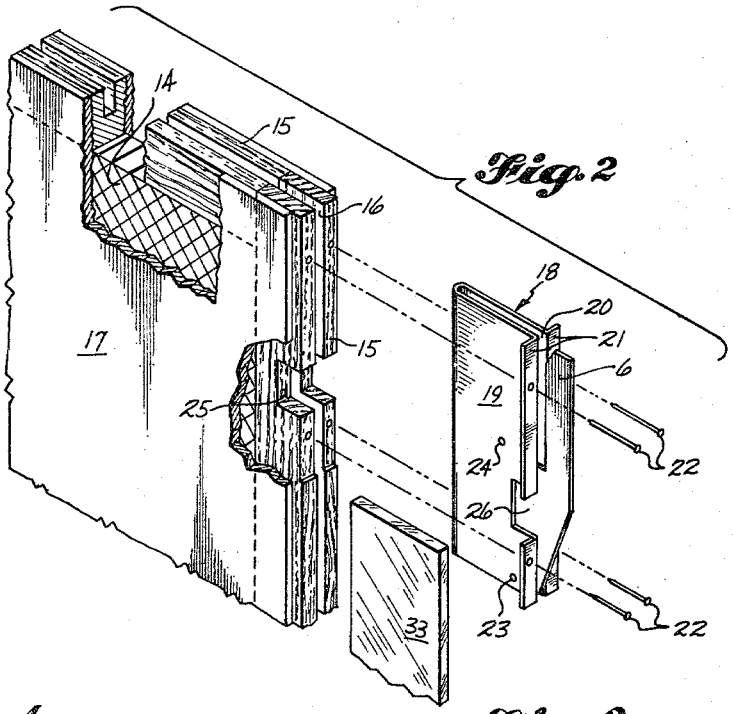
Fig. 2
Fig. 4
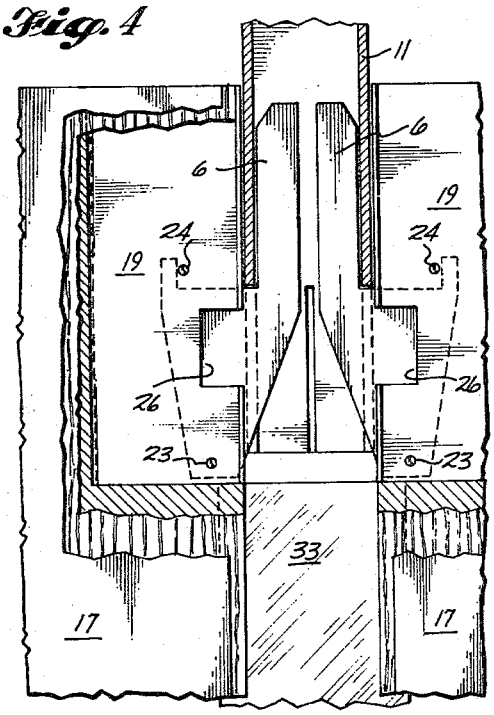
Fig. 3
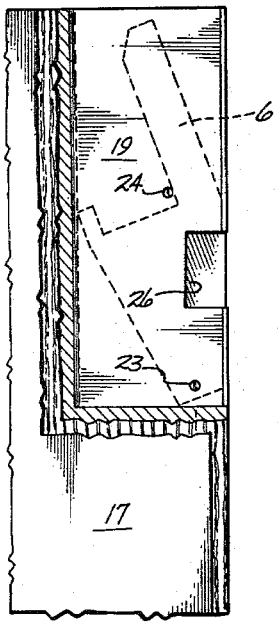

MODULAR BUILDING STRUCTURE

CROSS-REFERENCE

This application is a continuation application of United States Ser. No. 796,974, filed May 16, 1977, now U.S. Pat. No. 4,186,533, issued Feb. 5, 1980, for Modular Building Structure.

BACKGROUND OF THE INVENTION

1. Field of the Invention

The present invention relates to modular building structures.

2. Prior Art

German Utility Model No. 1,982,065 shows fixed hooks and tubular connectors for connecting exhibition stall wall panels.

German Utility Model No. 1,885,302 shows wall panels connected by hooks to square posts between the panels and overhead beams bolted to the upper ends of such posts.

SUMMARY OF THE INVENTION

It is an object of the present invention to provide modular building structures having component parts that can be quickly and easily assembled or disassembled.

A further object is to provide such structures having component parts which may be assembled to provide structures of a variety of shapes.

It is also an object to provide such structures particularly adapted for exhibit arrays to display and protect two-dimensional and three-dimensional material for the specific exhibit requirements of museums, art galleries, trade fairs and retail stores.

Another object is to provide a stable assembly of panels. Panel stability is provided by overhead beams and/or by connecting panels in angular relationship instead of being coplanar.

The foregoing objects can be accomplished by providing wall panels which can be interconnected by upwardly directed hooks projecting outwardy from the panel edges. Multisided hollow connection members having a downwardly-opening lower longitudinal slot in each side connect adjacent panels by the panel hooks being received in the connection member lower slots. Panels can be connected at angles to be mutually supporting. To steady connected panels, overhead beams are connected to each other and to the upper ends of the panels by downwardly directed beam hooks received in upwardly-opening upper longitudinal slots in the connection members. Such beams may carry electric circuit wires.

BRIEF DESCRIPTION OF THE DRAWINGS

FIG. 2 is a fragmentary exploded top perspective of an upper corner of a wall panel in accordance with the present invention with some parts broken away.

FIG. 3 is a fragmentary elevation of a wall panel with its hook in retracted position with some parts broken away.

FIG. 4 is a fragmentary elevation of two wall panels connected by a connection member, some parts being broken away and some parts being shown in section.

As shown in FIG. 1, representative component parts of a modular building structure include floor components 1 of equilateral triangle cross section. The sides of each floor component are formed by base strips 2 covered by a top 3 whose edges are coplanar with the outside of the strips. The floor components are maintained with a side of one component parallel to, spaced from and in alignment with a side of another floor component by a spacer 4 secured to both components such as by bolts extending through apertures in the base strips and spacer.

Figure 1:
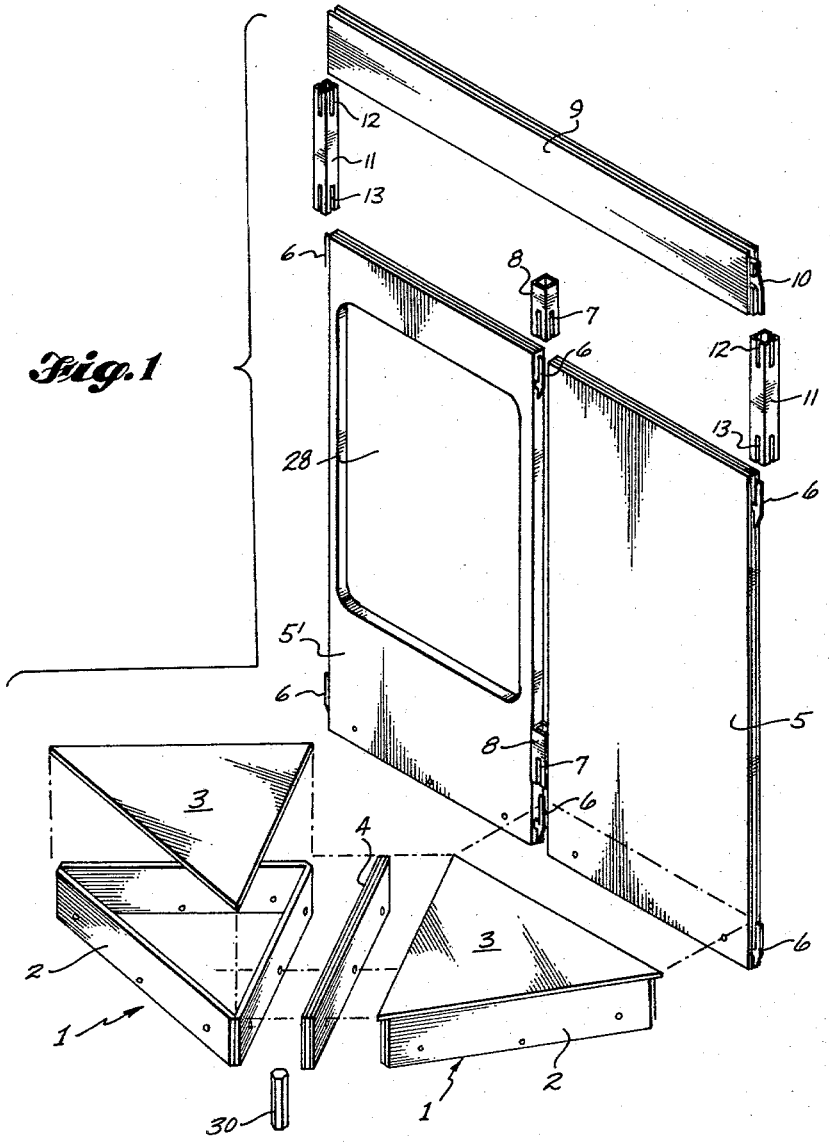
FIG. 1 is an exploded top perspective of some representative component parts of a modular building structure in accordance with the present invention.

One of the floor components may have a side secured to the lower portion of a wall panel 5 and the lower edge of a panel, instead of a spacer, may fit between adjacent floor components. Each panel has upwardly directed hooks 6 projecting outwardly from its opposite vertical edges. Panel 5 is positioned with an edge adjacent to the edge of another panel 5' which also has upwardly directed hooks 6. The two panels are connected by their adjacent hooks being received in the lower longitudinal slots 7 in opposite sides of multisided hollow connection members 8 formed of short lengths of tubular extrusion.

As best seen in FIGS. 2, 3 and 4, each wall panel is of conventional construction and includes a core 14 enclosed by perimetric channel members 15, the flanges of which define an outwardly opening groove 16, and a thin outer wall covering or facing 17. Hooks may be fixedly secured to the panel edges at corresponding locations on different panels. However, in the panel shown in FIGS. 3, 4 and 5 each hook 6 is carried by a bracket 18 which includes a return bent channel portion 19 forming an outwardly-opening slot 20 and attachment flanges 21. Such flanges are secured to a vertical edge of the panel by screws 22 so that the bracket channel portion is received in the panel perimetric groove. The panel edge is recessed to receive the bracket flanges.

A panel hook 6 swingably carried by bracket 18 by a pivot 23 is planar and has an elongated hook portion that fits closely in the slot 20. Such pivot is always located below the elongated hook portion. Such hook is swingable about its axis to move its elongated hook portion to opposite sides of a vertical plane parallel and adjacent to the axis of the pivot from a position where such elongated hook portion projects outwardly from the panel edge and the center of gravity of the hook is outward of the pivot to a position retracted substantially within the bracket slot 20 and the panel groove 16 in which the center of gravity of the hook is located inward of the pivot to maintain the hook in retracted condition. Outward swinging of the hook is limited by a stop 24 in a position in which its elongated inner edge is located parallel and close to the panel edge. As best seen in FIG. 3, access to a retracted hook is provided by a transverse notch 25 in the panel edge and an aligned notch 26 in the bracket.

Figure 5:
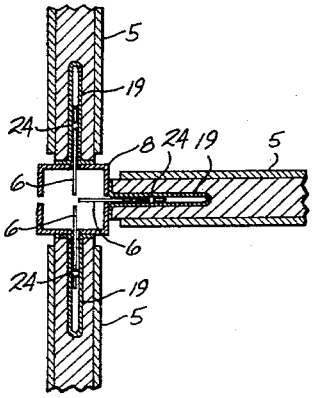
FIG. 5 is a fragmentary plan of three wall panels connected by a square connection member.

As shown in FIGS. 4 and 5, two coplanar panels can be connected edge-to-edge by their adjacent projected hooks 6 being received in the lower longitudinal slots in the opposite sides of a panel connection tubular member 8, shown in FIGS. 1 and 5, or a beam-and-panel connection member 11, shown in FIGS. 1 and 4. The tube wall fits snugly between the elongated hook edge and the adjacent panel edge. The tips of hooks 6 are beveled to guide a connection tube as it is fitted over the hooks. The margins of a filler strip 33 of sheet material may be fitted into the grooves of the panels to bridge between the adjacent panel edges.

Figure 6:
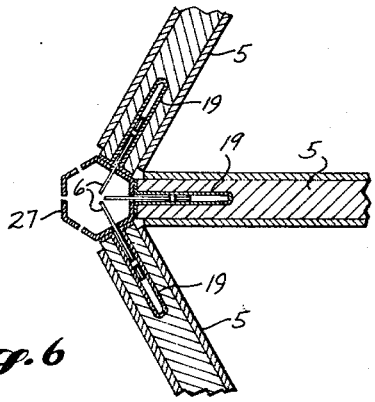
FIG. 6 is a fragmentary plane of three panels connected by a hexagonal connection member.

As best seen in FIG. 5, if connection members having a square cross section are used, two or more panels can be interconnected so that each panel is perpendicular to at least one other panel. As shown in FIG. 6, connection members 27 of hexagon cross section may be used to connect panels to each other at angles of 60 degrees or multiples of 60 degrees. The distance between the opposite sides of the square connection member 8 is the same as the distance between the opposite sides of the hexagonal connection member 27. However, the width of each side of the square connection member is slightly greater than the thickness of a panel, whereas the width of each side of the hexagon connection member is slightly less than the thickness of a panel.

Figure 7:
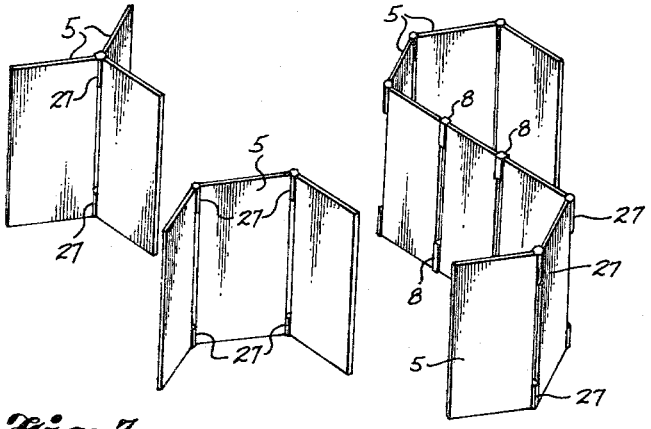
FIG. 7 is a top perspective of several wall panels connected at angles to each other for mutual support.
Figure 8:
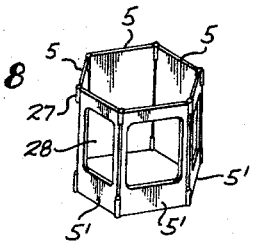
FIGS. 8, 9 and 10 are top perspectives of wall panels connected edge-to-edge to provide support and stability of the panels such as in forming display cases.
Figure 9:
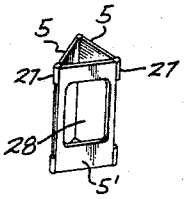
Figure 10:
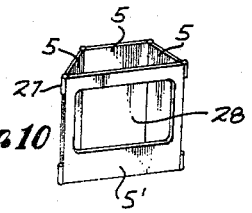

As shown in FIG. 7, several panels may be connected at angles to each other so that such panels are freestanding and mutually supporting, requiring no posts. FIGS. 8 and 9 show one or more panels 5' having viewing apertures 28 connected edge-to-edge to unapertured panels 5 to form a substantially enclosed display case. In the display case of FIG. 10, a double width apertured panel is connected to standard unapertured panels.

Figure 11:
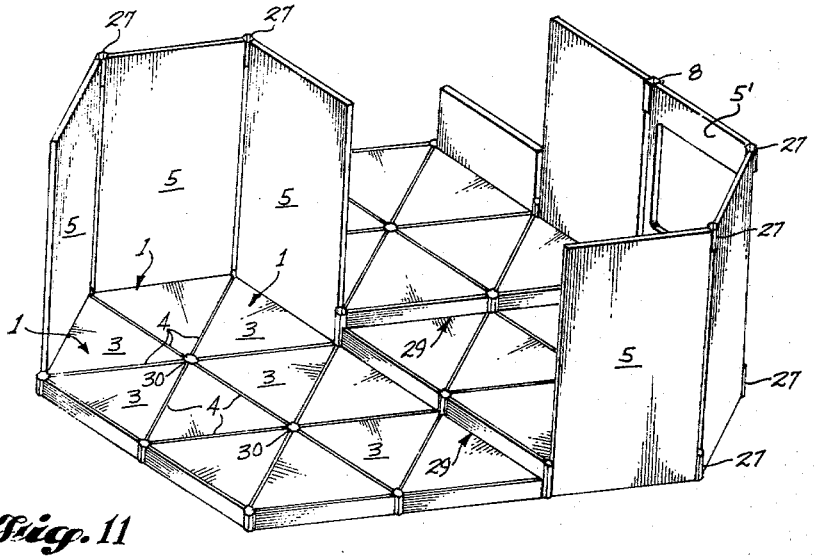
FIG. 11 is a top perspective of an exhibit array of wall panels supported by modular floor components.

In the exhibit array of FIG. 11, connected panels are supported by floor components 1 secured to the lower portions of such panels. The floor components may all be of the same height, or floor components of different heights may be used to provide steps 29 for staging or seating depending upon the degree of difference of elevation between the various levels. Spacers 4, also shown in FIG. 1, between adjacent floor components are of a height of at least as great as an assembled floor component to keep the component tops 3 from sliding. Hexagonal plugs 30 fill the gaps between the vertices of the connected floor components. Some of the panels act as spacers and are clamped between floor components.

Figure 12:
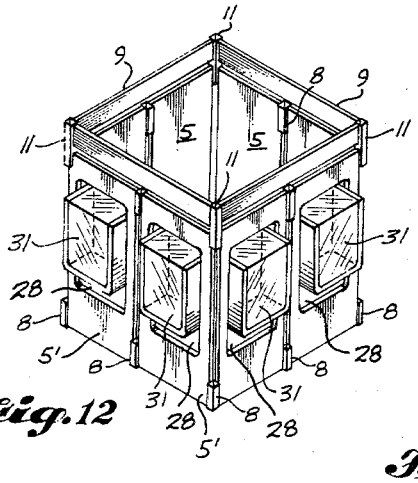
FIG. 12 is a top perspective of wall panels connected edge-to-edge to form a display case with overhead beams connected to each other and to the wall panels by beam connection members.

Another method of supporting connected panels is shown in FIG. 12. In that figure eight panels are connected to form a square display case with the length of each side of the square equal to the combined widths of two panels and a panel connection member, and overhead beams 9 have an equal length. As best shown in FIG. 1, the fixed downwardly directed hooks 10 projecting from each of the overhead beam ends are received in the upper longitudinal slots 12 of beam-and-panel connection members 11 and the lower longitudinal slots 13 of the beam-and-panel connection members 11 receive the upper panel hooks 6. In the freestanding, post-free display case of FIG. 12 adjacent panel hooks at the upper corners of the display case are received in the lower slots of the beam-and-panel connection member. Each of the beams has an upper groove, best seen in FIG. 1, for receiving electrical wiring or downwardly projecting lugs of display accessories such as lights or specialized power outlets. In several of the panels a display box 31 enclosed in transparent plastic is mounted in a panel viewing aperture 28 as alternates to windows or openings.

Figure 13:
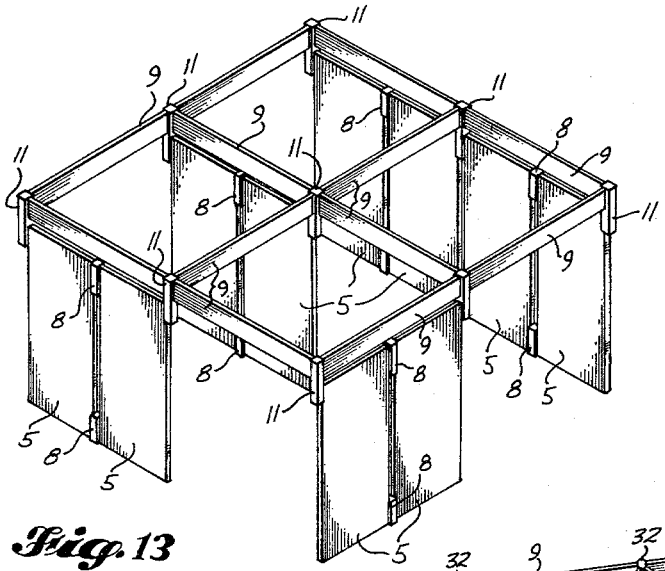
FIGS. 13 and 14, on the drawing sheet with FIGS. 5 and 6, are top perspectives of exhibit arrays with coplanar connected wall panels steadied by overhead beams.
Figure 14:
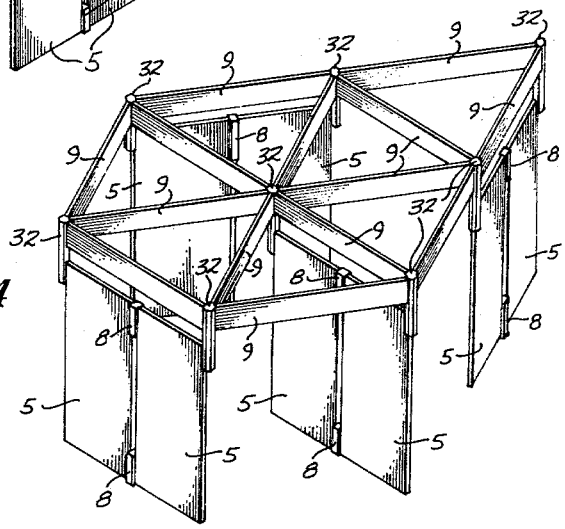

In FIGS. 13 and 14 an exhibit array of panels 5 is steadied by interconnected overhead beams 9. Such array includes a number of walls each formed by a row of a plurality of panels arranged in edge-to-edge relationship. In FIG. 13 connectors 8 connect the adjacent edges of adjacent panels in the row and square beam connection members 11 are used to connect the opposite end portions of beams 9 to the opposite edges, respectively, of the assembly of panels in each row so that the plurality of assembled panels in each row are maintained in coplanar relationship, whereas in FIG. 14 hexagonal beam connection members 32 are used to connect the opposite end portions of the beams to the opposite edges, respectively, of each row of panels. In the exhibit array shown in FIG. 15 some of the panels **5*a* are arranged in freestanding groups, such panels being connected at angles to adjacent panels for mutual support; many of the panels 5*b* are steadied by interconnected overhead beams; and some of the panels 5*c* can have their lower portions secured to modular floor components. Each beam end is connected to the top of a panel by a hexagonal beam-and-panel connection member 32. However, a beam connection member 32' can interconnect several beams not overlying panels as shown in FIG. 15**.

Figure 15:
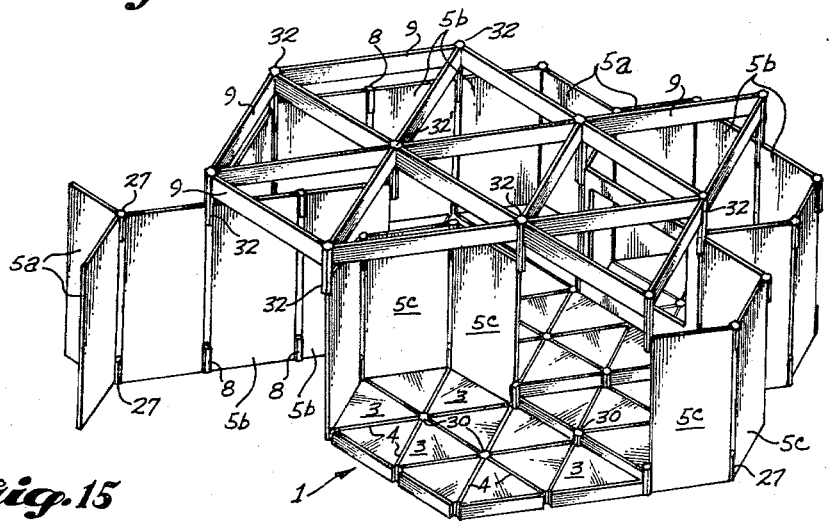
FIG. 15, on the drawing sheet with FIG. 7, is a top perspective of an exhibit array with some wall panels connected at angles to each other for mutual support, some wall panels supported by floor components and some wall panels steadied by overhead beams.

In each of the embodiments shown in FIGS. 14 and 15, the panels have the same width; the hexagonal connection members have the same width and the floor components are of equilateral triangle cross section with a side of the triangle of a length equal to the width of a panel. Each overhead beam is shown as being of a length equal to the combined widths of two panels and one connection member, but such a beam could be equal to the combined widths of more panels and the connection members between them. The building structure components can be quickly and easily interconnected to form exhibit arrays of a variety of shapes.

The overhead beam arrangements shown in FIGS. 14 and 15 are particularly effective in supporting various types of freestanding, post-free wall arrays because of the rigidity resulting from the beam assemblies of triangular components. In each case, the basic component is an equilateral triangle formed by three of the beams 9 of equal length. The overhead beam assemblies also include nonorthogonal parallelogram formations composed of four beams with a fifth beam joining the closer apexes of the parallelogram for forming two equilateral triangles in the parallelogram formation. Another beam assembly formation is that of an isosceles trapezoid in which two beams form one side of the trapezoid and a single beam forms each of the other sides of the trapezoid. Two beam members then respectively join the opposite ends of the shorter parallel side of the isosceles trapezoid to the center of the longer parallel side of the isosceles trapezoid for forming three equilateral triangles in the trapezoid.

In still another beam assembly, six beam members can form an equilateral triangle having two beams end to end forming each side. Three more beams joining the centers of the sides of such triangle form four smaller equilateral triangles in the large triangle. Also six beam members of equal length can form a regular hexagonal formation, and an additional six beam members of the same length extend, respectively, between the angles of the hexagon and the center of the hexagon for forming six congruent equilateral triangles in the regular hexagon.

Various combinations of such beam assembly formations can be utilized depending upon the shape and extent of the panel display desired. In any particular instance, an overhead beam can extend over the upper edge of an array of a plurality panels arranged in coplanar edgewise relationship with the beam connected only to the opposite end portions of such array for maintaining the panels of the array in coplanar relationship. Alternatively, as shown in FIG. 15, opposite end portions of a beam can be connected to the opposite end portions of a panel array composed of three panels connected in flaring channel formation.

It will be evident that the components utilized in the present invention do not include posts and therefore can be combined to produce a wide variety of freestanding building structures.

I claim:

1. A freestanding, post-free modular building structure comprising an array of upright modular panels; panel-connecting means connecting adjacent edges of adjacent panels in said array; three overhead beam members, said beam members being horizontal and assembled in coplanar triangular relationship; and beam-and-panel connecting means connecting each end of said beam members with one adjacent beam member end with said beam members in such triangular relationship and interconnecting said interconnected beam member ends and said modular panels for supporting said interconnected beam members entirely above the upper edges of said array of panels with at least one of said beam members being parallel to at least one of said panels.

2. The building structure defined in claim 1, including seven beam members of equal length, five of said beam members being arranged in isosceles trapezoidal relationship, and the other two beam members respectively joining the opposite ends of the shorter parallel side of the isosceles trapezoid to the center of the longer parallel side of the isosceles trapezoid for forming three equilateral triangles in the isosceles trapezoid.

3. The building structure defined in claim 1, including nine beam members of equal length, six of said beam members being arranged in equilateral triangular relationship with two of said beam members forming each side of the triangle, and the other three beam members extending respectively between the three centers of adjacent sides of said equilateral triangle for forming four equilateral triangles in the first equilateral triangle.

4. The building structure defined in claim 1, including five beam members of equal length, four of said beam members being arranged in nonorthogonal parallelogram relationship, and the fifth beam member joining the closer apexes of the parallelogram for forming two equilateral triangles in the parallelogram.

5. The building structure defined in claim 4, in which the panel array includes two parallel panel assemblies each having a plurality of the panels arranged in edge-adjacent coplanar relationship with two of the beam members in the parallelogram relationship being parallel to and overlying the upper edges of said two panel assemblies, respectively, and the beam-and-panel connecting means connecting said two beam members to said two panel assemblies, respectively.

6. The building structure defined in claim 1, including twelve beam members of equal length, six of said beam members being arranged in regular hexagonal relationship, and the other six beam members extending respectively between the angles of the hexagon and the center of the hexagon for forming six equilateral triangles in the regular hexagon.

7. The building structure defined in claim 6, in which at least one of the beam members in the hexagonal relationship is parallel to and overlying at least one of the panels and at least one of the other beam members is parallel to and overlying another of the panels.

8. A post-free construction system comprising a plurality of panels assembled edgewise in a row, connecting means connecting the adjacent edges of adjacent panels for securing said panels in edge-to-edge assembled relationship, an overhead beam of a length approximately equal to the combined widths of said plurality of connected panels, and means connecting the opposite end portions of said beam and the opposite edges, respectively, of the assembly formed by said assembled panels with said beam disposed entirely above and extending over the upper edges of said assembled panels for maintaining said assembled panels in coplanar relationship by connection of said beam to the panels of said row of panels only at the opposite ends of said row.

9. In a modular panel including two outer wall surfaces and an edge between and joining such surfaces, such edge having a slot therein, an elongated connecting hook mounted in such slot and retractable from a position projecting outward from such slot beyond the panel edge to a position completely retracted into such slot inward of such panel edge, the improvement comprising the slotted panel edge further having a transverse notch extending the entire width of such edge from one panel outer wall surface to the other panel outer wall surface, intersecting such slot and opening through the opposite outer panel wall surfaces for exposing a portion of said connecting hook inward of and adjacent to such panel edge when said hook is in its retracted position so that it can be grasped manually and pulled from its retracted position to its projected position.

10. A freestanding, post-free modular building structure comprising an array of upright modular panels, panel-connecting means connecting adjacent edges of adjacent panels in said array, a beam member disposed entirely above and extending over the upper edge of at least one panel, and beam-and-panel connecting means connecting said beam member to at least two panels in said array only at the ends of said beam member.

11. The building structure defined in claim 1 or 10, in which the panel-connecting means includes upper and lower connection members joining adjacent edges of two adjacent panels in positions spaced apart transversely of such adjacent edges, each of said adjacent panel edges having a groove between said connection members, and a filler strip of sheet material extending lengthwise of said adjacent panel edges between said connection members and bridging unbrokenly between said adjacent panel edges with the opposite margins of said filler strip fitted into the respective grooves of said adjacent panel edges.

12. The building structure defined in claim 1 or 10, in which one of the modular panels includes two outer wall surfaces and an edge between and joining said surfaces and having a slot therein, and the panel-connecting means includes an elongated hook mounted in such slot and retractable from a position projecting outward from such slot beyond said panel edge to a position completely retracted into such slot inward of said panel edge, said slotted panel edge further having a transverse notch extending the entire width of said edge from one panel outer wall surface to the other panel outer wall surface, intersecting such slot and opening through the opposite outer panel wall surfaces for exposing a portion of said hook inward of and adjacent to said panel edge when said hook is in its retracted position so that it can be grasped manually and pulled from its retracted position to its projected position.

13. The building structure defined in claim 10, in which the beam-and-panel connecting means interconnects the adjacent ends of two beam members and a panel below said beam member ends.

14. The building structure defined in claim 1 or 10, including at least two sets of interconnected panels which panel sets are connected together only by the beam members and beam-and-panel connecting means.

15. The building structure defined in claim 10, in which an edge of one of the panels has a slot, and the panel-connecting means includes a connecting hook having an elongated hook portion fittable in said panel edge slot and pivot means always located below said elongated hook portion and connecting said connecting hook and such one panel for swinging of said connecting hook to move said elongated hook portion to opposite sides of a vertical plane parellel and adjacent to the axis of said pivot means between a position retracted into said panel edge slot and a position projected out of said panel edge slot with said elongated hook portion projecting upward in cantilever fashion, the center of gravity of said connecting hook being located inwardly of the axis of said pivot means when said elongated hook portion is retracted into said panel edge slot and the center of gravity of said connecting hook being located outwardly of the axis of said pivot means when said elongated hook portion is in its projected position for maintaining said elongated hook portion selectively in such retracted and projected positions.

16. The building structure defined in claim 10, in which the panel array includes an assembly of a plurality of the panels arranged in coplanar relationship, and the beam member and said panel assembly are connected only at the opposite end portions of the beam member by the beam-and-panel connecting means with said beam member being disposed entirely above and extending over the upper edge of said panel assembly for maintaining the panels of said assembly in coplanar relationship.

17. The building structure defined in claim 16, in which the panel array is composed of only two panels.

18. A modular building structure comprising an array of upright modular panels, and panel-connecting means connecting adjacent edges of adjacent panels in said array, an edge of one of said panels having in it a slot, said panel-connecting means including a connecting hook having an elongated hook portion fittable in said panel edge slot and pivot means always located below said elongated hook portion and connecting said connecting hook and said one panel for swinging of said connecting hook to move said elongated hook portion to opposite sides of a vertical plane parallel and adjacent to the axis of said pivot means between a position retracted into said panel edge slot and a position projected out of said panel edge slot with said elongated hook portion projecting upward in cantilever fashion, the center of gravity of said connecting hook being located inwardly of the axis of said pivot means when said elongated hook portion is retracted into said panel edge slot and the center of gravity of said connecting hook being located outwardly of the axis of said pivot means when said elongated hook portion is in its projected position for maintaining said elongated hook portion selectively in such retracted and projected positions.

19. The building structure defined in claim 15 or 18, and a channel-shaped insert received in the panel edge and forming the slot for the panel-connecting hook.

20. The building structure defined in claim 15 or 18, including stop means located within the panel edge slot and engageable by the connecting hook for limiting the degree of outward swing of the elongated hook portion.

21. The building structure defined in claim 15 or 18, in which the elongated hook portion is planar and has an elongated straight edge which, when the elongated planar hook portion is in its projected position, is located outwardly of and close and parallel to the adjacent panel edge, the pivot means connects the panel and a portion of the connecting hook below such elongated planar hook portion, and a tube having a wall portion snugly slidable between said elongated straight edge and the panel edge when said elongated hook portion is in its projected position.

22. The building structure defined in claim 21, in which the tube has a longitudinal slot for closely embracing the portion of the hook between its elongated straight edge and the pivot means when the tube wall portion is located between the elongated straight edge and the panel edge.

* * * * *

UNITED STATES PATENT AND TRADEMARK OFFICE

CERTIFICATE OF CORRECTION

PATENT NO. : 4,295,307

DATED : October 20, 1981

INVENTOR(S) : David C. Jensen

It is certified that error appears in the above-identified patent and that said Letters Patent are hereby corrected as shown below:

Title page, [76] Inventor, cancel "2357 Riverside Dr., North Vancouver, British Columbia, Canada, V6B 1C8" and insert ---415 West Cordova Street, #17, Vancouver, British Columbia V6B 1E5 Canada---.

Signed and Sealed this

*Twenty-fifth* Day of *May 1982*

[SEAL]

*Attest:*

GERALD J. MOSSINGHOFF

*Attesting Officer*

*Commissioner of Patents and Trademarks*